United States Patent [19]

Kattenbroek et al.

[11] 4,287,982

[45] Sep. 8, 1981

[54] APPARATUS FOR CONSECUTIVELY DISCHARGING OBJECTS FROM CONTAINERS

[75] Inventors: Hendrik J. Kattenbroek; Jan Plug, both of Barneveld, Netherlands

[73] Assignee: Moba Holding Barneveld, Barneveld, Netherlands

[21] Appl. No.: 101,767

[22] Filed: Dec. 10, 1979

[30] Foreign Application Priority Data

Dec. 13, 1978 [NL] Netherlands ..... 7812116

[51] Int. Cl.[3] ..... B65G 47/46

[52] U.S. Cl. ..... 198/706; 198/370; 414/403

[58] Field of Search ..... 414/403; 198/370, 706, 198/796, 483

[56] References Cited

U.S. PATENT DOCUMENTS 3,749,260 7/1973 Mosterd ..... 414/787

FOREIGN PATENT DOCUMENTS 144210 4/1975 Netherlands .

*Primary Examiner*—Lawrence J. Oresky

*Attorney, Agent, or Firm*—Larson and Taylor

[57] ABSTRACT

Apparatus for consecutively discharging objects from containers moving along a fixed path having a number of discharge points therealong. The apparatus includes a rotatable control sleeve extending along the path with a device arranged at each of the discharge points to cause passing containers to discharge consecutively. A driving member is provided to effect rotation of the control sleeve to a succession of discharging conditions and a further device is provided to prevent over advancement or run-back of the control sleeve with respect to certain discharge positions assumed by the latter. A further device is provided to permit the control sleeve to return rapidly to an initial operating condition on discharge of the last of a series of containers.

9 Claims, 8 Drawing Figures

APPARATUS FOR CONSECUTIVELY DISCHARGING OBJECTS FROM CONTAINERS

The invention relates to an apparatus for consecutively discharging containers moving along a fixed path one after another having a number of discharge points, in which the first of the said containers discharges at a first discharge point, the second of the containers discharges at a second discharge point preceding the first thereof in the direction of movement of the containers and so on until a container is discharged at the last one of the said discharge points. Containers of this type are shown in U.S. Pat. No. 3,749,260. The apparatus is provided with a rotatably arranged control sleeve carrying at least oe discharge stop located at each of the said discharge points. Each of the discharge stops is located at an annular position particular thereto on the control sleeve and depending on the angular position of the control sleeve in the path of discharge pawls, each of which is mounted to a container in which a driving means is provided to exercise mechanical urgence of the control sleeve in a particular direction of rotation and in which each discharge point is provided with a detent member which co-operates with a corresponding one of a number of stop pawls, all of which are arranged to co-operate with an appropriate container in order to cancel out the operative co-operation between a concerned one of the stop pawls with a corresponding one of the detent members such that the control shaft can exercise a rotating movement under the influence of the mechanical urgence imparted thereto by the said driving means.

Such an apparatus is described in the Dutch Patent Specification No. 144,210.

The object of the present invention is to provide an improvement to this apparatus which, through greater simplicity, has a higher degree of reliability and in which, after a container has been discharged at each of all the discharge points, the control sleeve requires less time in assuming a position in which discharge can once again take place at the first of the discharge points.

The foregoing objects are achieved according to the invention in that the said driving means comprises a driving member coupled to the control sleeve by means of a coupling operative to exercise a driving function on the control sleeve in one direction only and corresponding to the said particular direction of rotation of the control sleeve under the influence of the said mechanical urgence imparted thereto, and in that said driving member is coupled to a resetting device which is adapted to move the driving member to a particular position against the influence of the mechanical urgence imparted thereto and thereafter to subject the driving member again to the mechanical urgence which, via the coupling operating in one direction, is also imparted in the said particular direction to the control sleeve.

A principally simple design of resetting device is possible if, in a following embodiment of the invention, the resetting device comprises a resetting coupling which is operatively arranged to execute a complete rotation or a fraction thereof and the operation of which said resetting coupling is achieved by the positive operation of a releasing member connected to said driving member.

According to another aspect of the invention, and in order to inhibit continuance of rotation of the control sleeve during and after resetting of the resetting device, the control sleeve is further provied with another detent member arranged to co-operate with yet another stop pawl which is also arranged to co-operate with an appropriate container, and in that the said other detent member and stop pawl co-act to permit the control sleeve to continue to rotate over a greater angle of rotation than that over which the control sleeve is permitted to rotate after operation of each of the preceding stop pawls.

In order to inhibit reversal of direction of the control sleeve during the resetting of the driving member, and in accordance with another aspect of the invention, a reversely operating detent member and a reversely operating stop pawl are provided both of which act to inhibit reverse rotation of the control sleeve during resetting of the driving member.

In the application of the invention, it is of importance that the driving memer has a very reliable and constant coupling with a releasing member, and an equally reliable connection to, for example, a pulling mechanism for the generation of a mechanical tension which provides an urging force.

According to yet another aspect of the invention, the driving member is of a synthetic material whereas the pulling members are integral with the driving member in the zones of connection therewith and of the same synthetic material, in which the driving member is urged in the direction towards the control sleeve under spring action and possesses tangentially rising and falling surfaces on the end surface thereof lying opposite the control sleeve, which rising and falling surfaces co-operate with corresponding portions of the oppositely lying end surface of the control sleeve.

In the application of the invention, the control sleeve can be permitted to make a complete revolution, a half a revolution, a thid of a revolution etc. In practice it has appeared that, with a sufficient degree of separation between discharge stops a high operating speed is obtainable by arranging two discharge stops per discharge point and by adjusting the resetting device to reset the driving member with so small a rotational movement as half a revolution.

The invention is now to be further described with reference to the accompanying drawings in which.

Figure 1:
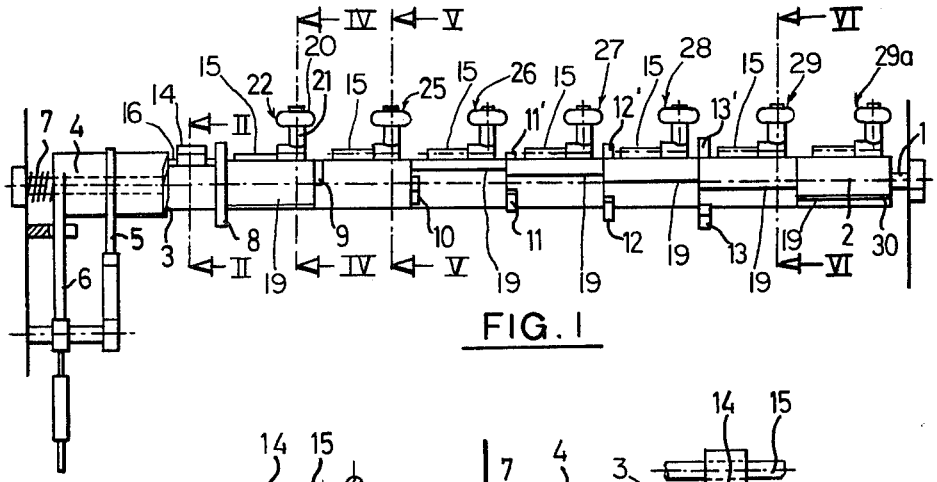
FIG. 1 is a schematic view of the control sleeve with the associated discharge stops, stop pawls and detent members.

FIG. 1 shows a spindle 1 with a control sleeve rotatably mounted thereon and generally indicated by the reference numeral 2. The leftwardly disposed end face 3 of the control sleeve 2 is formed to provide a half-member of a coupling operating in one direction only. The spindle 1 also accomodates a driving member 4 thereon which is affixed to two pulling members 5 and 6 and which is urged toward the control sleeve 2 by means of a compression spring 7. The control sleeve carris a first discharge stop 8 thereon, which discharge stop 8 is produced as a simple circumscribing ring and which, as the result herefrom, executes a discharge working effect in all positions of the control sleeve. In addition hereto, discharge stops 9, 10, 11, 12 and 13 are also carried on the control sleeve 2 and arranged with a particular radial angle of displacement with respect to one anothr. As will appear from the following, pairs of corresponding discharge stops such as those indicated by the reference numerals 9', 10', 11', 12' and 13' are arranged in the same axial positions on the control sleeve 2. All of 9' to 13' appear in FIG. 6, whereas only 11', 12' and 13' appear in FIG. 1.

Figure 2:
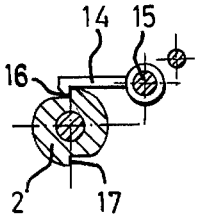
FIG. 2 is a detailed cross-section along the line II—II.

As will be seen from the cross-section II—II of FIG. 2, a stop pawl 14 is arranged on a spindle 15 for free rotation with respect thereto and arranged to co-operate with a pair of detent members 16 and 17 carried by the control sleeve 2. The stop pawl 14 cannot be operated by a container 23 and only acts to inhibit leftward rotation (anti-clockwise as viewed in FIG. 2) of the control sleeve 2 in certain positions thereof and in a manner later to be described herein.

Figure 3:
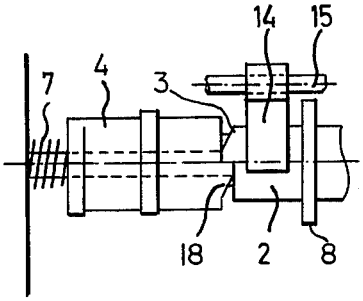
FIG. 3 is a plan view of the left portion of FIG. 1.

FIG. 3 shows the same stop pawl 14 together with the driving member 4 in plan view, from which figure it will be seen that the driving member 4 is provided with axially rising faces on the end thereof adjacent to control sleeve 2 and one of which rising surfaces is indicated by the reference numeral 18. The action of these faces is such that when the driving member 4 is rotated, it can move leftward against the action of the compression spring 7 and thereafter spring back again. This form of mechanism is well-known in itself and, as drawn, the axial faces 18 of the driving member 4 and the control sleeve 2 lie in engagement with one another.

Figure 4:
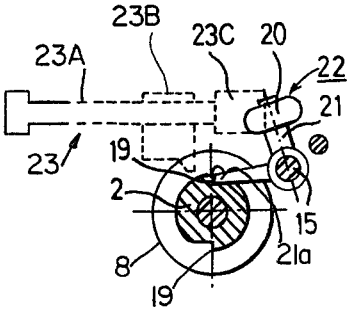
FIG. 4 is a cross-section along the line IV'IV.

FIG. 4 shows a cross-section along the line IV—IV from which it will be seen that the control sleeve 2 is provided with detent members 19 arranged in diametrically opposite positions, with which detent members a stop pawl 22 can co-operate. This last mentioned stop pawl 22 is also mounted on the spindle 15 and is provided with an articulated arm 21 which accomodates a follower-roller 20 thereon at one end, and engages detent members 19 at its other end 21*a*. The chain-dotted lines in FIG. 4 are representative of a part of an appropriate container 23 and, as will be seen from FIG. 4, part 23*c* of the container will engage the follower-roller 20 and as a result thereof the stop pawl of FIG. 4 will be caused to pivot clockwise as viewed in FIG. 4. Through this action, the end 21*a* of the stop-pawl 22 is removed from engagement with detent member 19 whereafter control sleeve 2 is permitted to rotate clockwise as viewed in FIG. 4.

Figure 5:
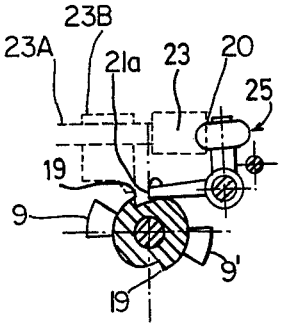
FIG. 5 is a cross-section along the line V—V but showing only that portion of the sleeve 2 which the section V—V is taken.
Figure 6:
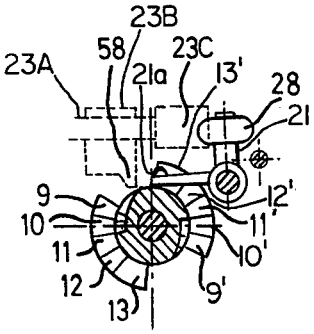
FIG. 6 shows a cross-section along the line VI—VI.

As will be understood by one of ordinary skill in the art, the illustrated apparatus is mounted adjacent a conveyor which moves from right to left in FIG. 1, and which, in FIGS. 4–6 is located to the left of the figures and moves perpendicular to the plane of the drawing, toward the viewer. The end of container 23 would in some manner be affixed to rod 23 A which, in addition to its movement with the conveyor, is rotatable about its own axis and has affixed thereto a part 23B which has discharge part 58 at the bottom thereof, and an end part 23C which acts upon follower rollers 20. It will be seen that when part 58 engages a discharge stop 9 to 13 or 9' to 13', continued movement of the conveyor will cause rod 23A to turn about its axis, which then causes the discharge of the items in that container 23. Containers of this type are well known. See for example, U.S. Pat. No. 3,749,260.

In FIG. 5, a cross-section along the line V—V is shown, that is to say a cross-section of the following one of the stop pawls designated by the reference numeral 25. In this figure the stop pawl 25 is shown pivotted somewhat rightward due to the fact that end 21*a* of its articulated arm 21 is not in its lowest point of engagement with a detent member 19 in the control sleeve 2. In these relative positions of the control sleeve 2 and the articulated arm of the pawl 25, the coactive working effect between its follower-roller 20 and the portion 23*c* of the appropriate container 23 is less. This condition in itself has no functional consequences, but the reduced movement of the stop pawl 25 is otherwise of no hindrance.

After the appropriate container 23 has released the stop pawl through the engagement of the follower-roller 20 thereof, the control sleeve 2 will rotate under the action of the urging force applied thereto and through which, as shown in FIG. 5, the stop pawl 25 comes into operative engagement with its associated detent member 19. As the result of this last quoted operative engagement, and due to the fact that a notch in the control sleeve 2 constitutes the detent member 19, this implies a counter clockwise pivoting of the articulated arm 21 of the stop pawl 25, through which its associated follower-roller 20 is moved in its entirety and completely in the path of part 23C of a following appropriate container 23. This means that, via the portion 23C thereof, a following container 23 will cause the stop pawl 25 to pivot and through this action the control sleeve 2 is released again, and so on.

The discharge (i.e., turning of each rod part 23A about its axis) of containers can now commence. Beginning with the conditions obtaining as illustrated, the discharge operations for the containers ensue as follows: The part 23C of the first of the containers 23 travelling from right to left in FIG. 1 engages the follower-roller 20 of the stop pawl 22 which is raised to allow the control sleeve 2 to rotate clockwise (as viewed in FIGS. 4–6) one step. These actions result in displacement of the discharge stop 9 into the path of the discharge member 58 on part 23B of the following container 23. The portion 23C of this container 23, through its co-operation with the follower-roller 20 of the stop pawl 25, ensures that the control sleeve 2 rotates one step further. These operations continue such that successive stop pawls 26,27,28 and 29 raise an associated detent member to permit the control sleeve to rotate further somewhat, and through which the discharge stops 10, 11, 12 and 13 are successively set to appropriate positions in order to be enabled to engage the discharge member 58 of a concerned one of the containers 23. The containers now discharge their contents in the intended sequence in a manner which is described above, but not illustrated herein since this process forms no part of the invention.

After six containers have been discharged, the following container comes into engagement with the stop pawl 29*a* cooperating with a detent memer 30. The control sleeve, as illustrated, is rotated through an angle of 20° for each step such that after stop pawls 22,25,26,27,28 and 29 have been operated, the control sleeve 2 has rotated through an angle of 120° approximately. After stop pawl 29*a* has been raised, the control sleeve rotates through 60°. Time is available for this relatively larger angular movement which is equal to the time required by the container, cooperating with the stop pawl 29*a*, to reach the stop pawl 22. A second advantage of this larger angular movement is that a relatively large movement is available to control the operation of a mechanism for resetting the driving member 4, which mechanism is later to be described herein.

Figure 7:
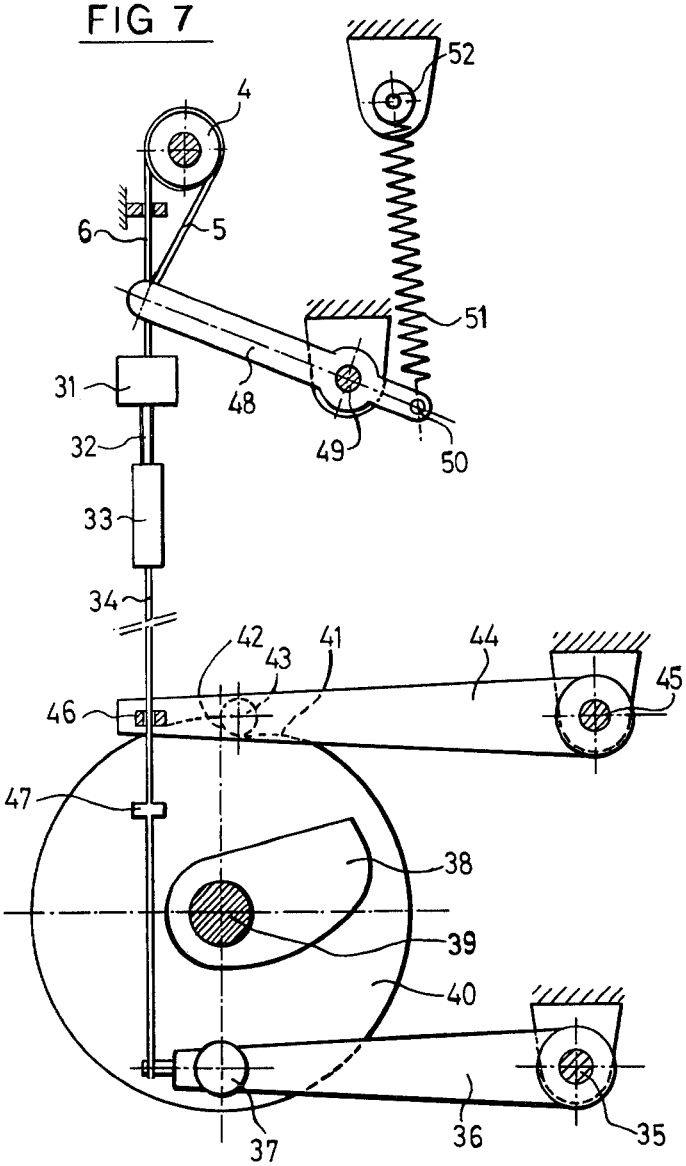
FIG. 7 shows a schematic view of the resetting mechanism.
Figure 8:
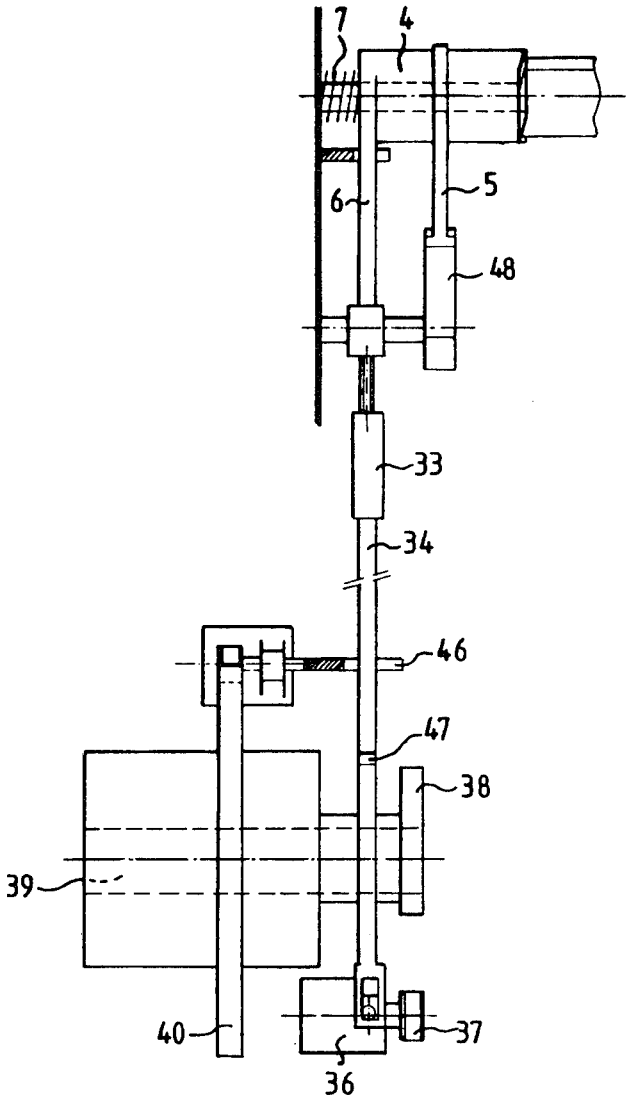
FIG. 8 shows a schematic side elevation of the mechanism of FIG. 7.

Through rotation of the control sleeve 2, the pulling member 6 is drawn even further upward (see FIGS. 7 and 8). This pulling member 6, principally consisting of tape, forms this monolythic entity with the driving member 4 made of a synthetic material and is affixed thereto by a suitable fixing member therefor designated by the reference numeral 31. This last quoted member is connected, by means of a threaded rod 32 coupled to an adjusting member 33, to a thin rod 34 the extreme end of which is affixed to an arm 36 pivotably mounted on a spindle 35. This arm 36 is provided with a follower 37 which co-operates with a cam 38. The cam is rotatable on the spindle 39 together with a disc 40 having a peripherally notched portion 41 which in turn has a steep profiled portion 42. The cam 38 and disc 40 are driven clockwise as viewed in FIG. 7 by means of a friction coupling. The steep profiled peripheral portion of the disc 40 co-acts with a stop member 43 to impede rotation of the disc 40 and the cam 38, unless the stop member 43 is raised clear of the peripherally notched portion 41 of the disc 40. This raising action is made possible insofar as the stop member 43 is mounted on a lever arm 44 pivotally arranged in the spindle 45 and provided with a stop 46 affixed to the lever arm 44. The stop 46 is arranged to co-operate with a release member 47 affixed to the rod 34.

The pulling member 5, also monolythically affixed to the control sleeve 2, is connected at its lower end to one end of a lever arm 48 which is pivotably arranged on the spindle 49. The other end of the lever arm 48 is connected to one end of a tension spring 51 by means of a pivot connection 50. The other end of the tension spring 51 is connected at a point 52 to a fixed portion of the apparatus frame. Through this arrangement mechanical tension is exercised on the driving member 4.

The operation of the resetting device takes place as follows:

When the driving member 4 pivots the control sleeve 2 clockwise in FIG. 7 through the co-operation of a container with stop pawls 22,25 to 29, the release member 47 finally comes into engagement with the stop 46 and pivots the lever arm 44 clockwise to release the disc 40 which then rotates through one revolution through which the cam 38 comes into engagement with the follower 37. These actions result in pivoting of the driving member 4 counter-clockwise though the combined actions of the rod 34, the threaded rod 32, the adjusting member 33 and the pulling memer 6. The counter-clockwise pivoting of the driving member amounts to a good half stroke thereof. When the cam 38 is no longer operatively co-operating with the follower 37 the driving member moves somewhat back, through which the coupling operating in one direction of rotation only, established between the right end face of the driving member 4 and the left end face of the control sleeve 2, once again comes into operation. Due to the fact that this movement has also moved the release member 47 downward, the lever arm 44 can now pivot back again whereby the stop member 43 can again engage the periphery of the disc 40 whereafter, on completion of a revolution of the disc 40, the lever arm 44 can move downward somewhat further to allow the stop member 44 to engage the steeply sloping peripheral portion 42 of the disc 40. Through this engagement, the lever arm 44 has reached its original position. Since at the instant of reverse movement of the stop pawl 22 reverse rotation of the control sleeve 2 is inhibited by the stop pawl 14, the driving member 4 can rotate back without thea control sleeve assuming an undefined position.

The apparatus according to the invention is simple which facilitates surveyance thereof and access thereto, such that a high degree of reliability is obtained apart from a higher permitted operating speed.

What we claim is:

1. In an apparatus for consecutively discharging containers, a driving means for a control sleeve provided with discharge stops, which driving means contains a rotatably mounted driving member, a coupling operative to transmit a driving torque from the driving member on the said control sleeve in one direction only, said driving member being connected to a device continuously exerting a torque on said driving member in said mentioned direction, a resetting device for rotating said driving member in the direction opposite to said mentioned direction, a release member for said resetting device being connected to said driving member and adapted to cooperate with said resetting device to activate to rotate said driving member a predetermined angle in said opposite direction and a means for preventing said sleeve to rotate in the said opposite direction.

2. Apparatus according to claim 1, characterized in that the said resetting device comprises a resetting coupling which is operatively arranged to execute a complete rotation or a fraction thereof and the operation of which said resetting coupling is achieved by the positive operation of a releasing member connected to the said driving member.

3. Apparatus according to claim 1 or claim 2, characterized in that the said resetting coupling is provided with a cam which is arranged to cooperate with a cam follower positively connected to the driving member.

4. Device according to claim 1 in which said control sleeve is at a number of axially spaced locations provided with detent members, each of said detent members being adapted to cooperate with a stop pawl, said stop pawls being mounted to be lifted by containers to allow said sleeve to rotate in said predetermined direction, until another detent cooperates with another stop pawl to stop said sleeve, said detents being spaced over the same angular distance corresponding to the angular distance between the said discharge stops, a further detent member cooperating with a further stop pawl being spaced over a greater angular distance than said first mentioned detent members from the last one of said first mentioned detent members.

5. Apparatus according to claim 1, in which the said driving member is arranged co-axial with the said control sleeve and rotates co-axially with respect thereto.

6. Apparatus according to claim 1, in which said means for preventing said sleeve to rotate in said opposite direction comprises a detent member of said sleeve and a stop pawl adapted to cooperate with said detent member.

7. Apparatus according to claim 1, in which said driving member is a roller integrally connected to two pulling members, one of which is connected to the pulling mechanism for applying a pulling force and the other of which carries a releasing member and is further connected to the resetting device in order to be subjected to a pulling force through which the driving member rotates back against the pulling force of the said mechanism acting on the first pulling member.

8. Apparatus according to claim 7, characterized in that the driving member is of synthetic material and in that the pulling members are integral with the driving member in the zones of connection therewith and of the same synthetic material, in which the driving member is urged in the direction towards the control sleeve under spring action and possesses tangentially arranged rising and steeply falling surfaces on the end face thereof lying opposite the control sleeve, said rising and falling surfaces cooperating with corresponding portions of the oppositely lying end surface of the control sleeve.

9. Apparatus according to claim 1, characterized in that two discharge stops are provided at the same axial locations on the sleeve but diamterically opposed to each other and in that the said resetting device is operative to reset the driving member half a revolution.

* * * * *